US008991317B2

(12) United States Patent
Fischnaller et al.

(10) Patent No.: US 8,991,317 B2
(45) Date of Patent: Mar. 31, 2015

(54) TRANSPORTATION UNIT FOR CABLE TRANSPORTATION SYSTEMS

(75) Inventors: Hannes Fischnaller, Villnöss (IT); Josef Rainer, Termeno Sulla Strada del Vino (IT)

(73) Assignee: Rolic International S.A.R.L., Luxembourg (LU)

( * ) Notice: Subject to any disclaimer, the term of this patent is extended or adjusted under 35 U.S.C. 154(b) by 297 days.

(21) Appl. No.: 13/382,778

(22) PCT Filed: Apr. 27, 2010

(86) PCT No.: PCT/EP2010/055640

§ 371 (c)(1), (2), (4) Date: Mar. 23, 2012

(87) PCT Pub. No.: WO2011/003639

PCT Pub. Date: Jan. 13, 2011

(65) Prior Publication Data

US 2012/0186485 A1 Jul. 26, 2012

(30) Foreign Application Priority Data

Jul. 9, 2009 (IT) ..... MI2009A1214

(51) Int. Cl.
*B61B 12/00* (2006.01)

(52) U.S. Cl.
CPC ..... *B61B 12/002* (2013.01)
USPC ..... 105/149.2

(58) Field of Classification Search
CPC .... A47D 15/005; A47D 15/006; B60R 21/02; B60R 22/28; B60R 2021/0004; B60R 2021/0097; B60R 2021/022; B61B 12/00; B61B 12/002
USPC ..... 105/149.1, 149.2; 297/487, 488, 297/216.11, 256.15, 467, 468
See application file for complete search history.

(56) References Cited

U.S. PATENT DOCUMENTS 472,211 A 4/1892 Fralinger
1,944,446 A 1/1934 McGowen
(Continued)

FOREIGN PATENT DOCUMENTS

AT 315910 6/1974
AT 342655 4/1978
(Continued)

OTHER PUBLICATIONS

Magazine Article entitled: No. Feb. 1989 Issue of Rivista Internazionale delle Funivie, p. 10, Figure 16, Nov. 1989.
(Continued)

*Primary Examiner* — Mark Le
(74) *Attorney, Agent, or Firm* — Neal, Gerber & Eisenberg LLP

(57) ABSTRACT

A transportation unit for a cable transportation system has a chair with a bench; a safety frame movable between an open position and a closed position and having a front bar; and at least one safety barrier, which is fixed to the front bar, extends predominantly between the front bar and the bench when the safety frame is in the closed position, and has a support with an anchoring portion fixed to the front bar, and a projecting portion, which projects from the anchoring portion, is elastically flexible under stress oriented in given or designated directions, and is substantially rigid under stress oriented in other directions.

22 Claims, 5 Drawing Sheets

(56) References Cited

U.S. PATENT DOCUMENTS

| | | | | | |
|---|---|---|---|---|---|
| 2,662,587 | A | | 12/1953 | McIlvaine | |
| 2,710,650 | A | | 6/1955 | Sowder | |
| 2,985,224 | A | | 5/1961 | Sowder | |
| 3,170,412 | A | | 2/1965 | Sowder | |
| 3,934,517 | A | | 1/1976 | Hirsig | |
| 3,975,037 | A | * | 8/1976 | Hontschik et al. | 280/733 |
| 4,185,562 | A | | 1/1980 | Hatori et al. | |
| 4,226,187 | A | | 10/1980 | Paulsen et al. | |
| 4,269,123 | A | | 5/1981 | Segafredo | |
| 4,280,411 | A | | 7/1981 | Katayose et al. | |
| 4,462,314 | A | | 7/1984 | Kunczynski | |
| 4,470,355 | A | | 9/1984 | Kunczynski | |
| 4,473,011 | A | | 9/1984 | Wuschek | |
| 4,640,197 | A | | 2/1987 | Brian | |
| 4,641,587 | A | | 2/1987 | Dalliard | |
| 4,671,187 | A | | 6/1987 | Kunczynski | |
| 4,833,997 | A | | 5/1989 | Cathiard | |
| 4,858,997 | A | * | 8/1989 | Shubin | 297/487 |
| 4,898,100 | A | | 2/1990 | Brochand | |
| 4,909,574 | A | * | 3/1990 | Sedlack | 297/488 |
| 5,107,771 | A | | 4/1992 | Kainz | |
| 5,113,768 | A | | 5/1992 | Brown | |
| 5,226,368 | A | | 7/1993 | Brochand et al. | |
| 5,515,789 | A | | 5/1996 | Brochand et al. | |
| 5,562,040 | A | | 10/1996 | Egli | |
| 5,582,109 | A | | 12/1996 | Levi et al. | |
| 5,595,122 | A | | 1/1997 | Levi et al. | |
| 6,036,282 | A | | 3/2000 | Clarke et al. | |
| 6,345,578 | B1 | | 2/2002 | Pabst | |
| 6,543,366 | B2 | | 4/2003 | Pabst et al. | |
| 6,585,232 | B2 | | 7/2003 | Rechenmacher | |
| 7,410,068 | B1 | | 8/2008 | Andreetto | |
| 7,549,377 | B2 | | 6/2009 | Pabst | |
| 2002/0026839 | A1 | | 3/2002 | Lehtovaara | |
| 2002/0088368 | A1 | | 7/2002 | Pabst et al. | |
| 2006/0249718 | A1 | | 11/2006 | Levi | |
| 2007/0169660 | A1 | | 7/2007 | Pabst | |
| 2007/0246993 | A1 | * | 10/2007 | Switzeny | 297/487 |
| 2008/0115689 | A1 | | 5/2008 | Heil et al. | |
| 2009/0165666 | A1 | | 7/2009 | Pabst et al. | |
| 2009/0165668 | A1 | | 7/2009 | Andreetto | |

FOREIGN PATENT DOCUMENTS

| | | |
|---|---|---|
| AT | 373832 | 2/1984 |
| AT | 388146 | 5/1989 |
| AT | 390926 | 7/1990 |
| AT | 404010 | 7/1998 |
| AT | 405269 | 6/1999 |
| AT | 411046 | 9/2003 |
| AT | 389087 | 3/2008 |
| CH | 259291 | 1/1949 |
| CH | 360704 | 3/1962 |
| CH | 542740 | 10/1973 |
| CH | 554761 | 10/1974 |
| CH | 671929 | 10/1989 |
| DE | 423865 | 1/1926 |
| DE | 2020746 | 12/1971 |
| DE | 2101743 | 9/1972 |
| DE | 2636888 | 5/1977 |
| DE | 3109294 | 10/1982 |
| DE | 3834116 | 5/1989 |
| DE | 3927757 | 3/1991 |
| DE | 4127373 | 2/1993 |
| DE | 9405016 U1 | 6/1994 |
| DE | 202007006169 | 7/2007 |
| EP | 0055955 | 7/1982 |
| EP | 0135239 | 3/1985 |
| EP | 0158095 | 10/1985 |
| EP | 0218306 | 4/1987 |
| EP | 0218897 | 4/1987 |
| EP | 0281205 | 9/1988 |
| EP | 0491632 | 6/1992 |
| EP | 0517622 | 12/1992 |
| EP | 0613807 | 9/1994 |
| EP | 0640518 | 3/1995 |
| EP | 0678433 | 10/1995 |
| EP | 0687607 | 12/1995 |
| EP | 0692418 | 1/1996 |
| EP | 0745526 | 12/1996 |
| EP | 0970864 | 1/2000 |
| EP | 1077167 | 2/2001 |
| EP | 1088729 | 4/2001 |
| EP | 1174323 | 1/2002 |
| EP | 1195305 | 4/2002 |
| EP | 1209055 | 5/2002 |
| EP | 1331151 | 7/2003 |
| EP | 1364853 | 11/2003 |
| EP | 1419950 | 5/2004 |
| EP | 1721801 | 11/2006 |
| EP | 1930224 | 6/2008 |
| FR | 891743 | 3/1944 |
| FR | 913146 | 8/1946 |
| FR | 1100001 | 9/1955 |
| FR | 1199721 | 12/1959 |
| FR | 1423648 | 1/1966 |
| FR | 2340895 | 9/1977 |
| FR | 2387830 | 11/1978 |
| FR | 2391450 | 12/1978 |
| FR | 2392858 | 12/1978 |
| FR | 2562857 | 10/1985 |
| FR | 2640247 | 6/1990 |
| FR | 2670452 | 6/1992 |
| FR | 2706404 | 12/1994 |
| FR | 2823482 | 10/2002 |
| FR | 2854853 | 11/2004 |
| FR | 2867142 | 9/2005 |
| GB | 1326264 | 8/1973 |
| GB | 1353030 | 5/1974 |
| GB | 1460106 | 12/1976 |
| GB | 2017024 | 9/1979 |
| WO | WO2004067347 | 8/2004 |
| WO | WO2004085221 | 10/2004 |
| WO | WO2005032901 | 4/2005 |
| WO | WO2008020021 | 2/2008 |
| WO | WO2008129017 | 10/2008 |
| WO | WO2008129019 | 10/2008 |
| WO | WO2009/000059 | 12/2008 |
| WO | WO2009019259 | 2/2009 |
| WO | WO2009053485 | 4/2009 |

OTHER PUBLICATIONS

Magazine Article entitled: No. May 1989 Issue of Revue Internationale des Telepheriques, p. 15, Figure 6, Jul. 1989.

* cited by examiner

A1
A2
D

TRANSPORTATION UNIT FOR CABLE TRANSPORTATION SYSTEMS

PRIORITY CLAIM

This application is a national stage application of PCT/EP2010/055640, filed on Apr. 27, 2010, which claims the benefit of and priority to Italian Patent Application No. MI2009A 001214, filed on Jul. 9, 2009, the entire contents of each are incorporated by reference herein.

BACKGROUND

Certain known cable transportation systems comprise a number of transportation units movable between at least two turnaround stations, and normally comprising cars or chairs. A cable transportation system comprising only cars is known as a cable-car, and one comprising only chairs is known as a chair-lift. In recent years, combination cable transportation systems comprising both chairs and cars have also become popular.

Chair-lifts, or any cable transportation system comprising chairs, involve safety issues, to prevent passengers from falling off.

Certain known chair-lift transportation units normally comprise a supporting frame attached to a draw cable; and a chair comprising a bench and a backrest. To prevent passengers from falling off the chair, each transportation unit is equipped with a safety frame hinged to the supporting frame and movable between a closed position and an open position allowing passengers on and off the chair. The safety frame comprises a front bar which, in the closed position, is located over the bench and in front of the backrest, to prevent passengers from falling off.

Some known transportation units comprise locking devices for locking the safety frame in the closed position along the route between the turnaround stations, and only releasing the safety frame along the route inside the turnaround stations.

The safety frame and locking devices of these known transportation units have done a lot to improve the safety of chair-lifts, but concern over passengers falling off still remains, owing to the safety frame and locking devices failing to prevent passengers from slipping off between the bench and the front bar, even when this is in the closed position. Incidents of this sort mainly involve passengers of small build, such as children, on account of the chairs, and therefore the distance between the front bar and the bench, normally being configured for adult passengers of medium build.

Various solutions have been proposed to at least partly solve the problem of passengers falling off the chair.

A first solution, chronologically, provides in fixing safety barriers to the front bar, as shown on page 10, FIG. 16 of the No. 2/1989 issue of Rivista Internazionale delle Funivie magazine, or on page 15, FIG. 6 of the No. 5/1989 issue of Revue Internationale des Téléphériques magazine.

The above magazines are substantially two issues of the same magazine in different languages, and show the same photograph of a chair produced by the Swiss company Von Roll, and wherein the safety barriers comprise brackets fixed to the front bar. Each bracket is located in front of and centrally with respect to a respective passenger seat, and extends between the front bar and the bench and centrally with respect to the passenger seat when the safety frame is in the closed position. In actual use, the safety barrier is located at least partly between the passenger's thighs, to prevent the passenger from falling off.

This technical solution was later taken up by the Swiss company Garaventa in Austrian Patent No. 411,046 B, in which the bracket is fitted in rotary manner to the front bar.

Other solutions proposed by Innova Patent GmbH in European Patent No. 1,721,801 B1 substantially all comprise a safety barrier having a contact surface located under and extending parallel to the front bar, and pressed elastically against the legs of the passenger(s) sitting in the chair.

The safety barriers described in European Patent No. 1,721,801 B1 are characterized by adapting elastically to the passenger's build, but are sometimes expensive to produce, call for careful maintenance, cause a certain amount of discomfort by exerting concentrated pressure on a small area of the passenger's thighs, and may give rise to lateral buckling under combined bending and compressive stress, when the movable member is not guided properly.

Generally speaking, the above-described solutions pose drawbacks in terms of passenger comfort.

SUMMARY

The present disclosure relates to a transportation unit for cable transportation systems.

According to one embodiment of the present disclosure, there is provided a transportation unit for cable transportation systems, wherein the transportation unit is movable in a travelling direction, and comprises a chair with a bench; a safety frame movable between an open position and a closed position and comprising a front bar; and at least one safety barrier, which is fixed to the front bar, extends predominantly between the front bar and the bench when the safety frame is in the closed position, and comprises a support with an anchoring portion fixed to the front bar, and at least one projecting portion, which projects from the anchoring portion, is elastically flexible under stress oriented in given or designated directions, and is substantially rigid under stress oriented in other directions.

The barrier can be located centrally with respect to a seat on the bench, and, being flexible under stress in given or designated directions, causes no injury to passengers in the event of accidental contact, and reduces the section through which the passenger's body could otherwise slip accidentally off the bench. Moreover, flexibility is easily controllable and poses no lateral buckling problems.

In one embodiment of the present disclosure, the projecting portion comprises at least one wall crosswise to the travelling direction, integral with the anchoring portion, and having at least one weakened portion to promote flexibility of the projecting portion and so define the given or designated stress directions.

The flexibility of the projecting portion can thus be controlled easily, to achieve a good safety-comfort compromise for passengers of any build.

It is thus an advantage of the present disclosure to provide a transportation unit for cable transportation systems, which is highly effective in preventing passengers from falling off, and at the same time provides for a high degree of comfort for passengers of any build.

Additional features and advantages are described in, and will be apparent from, the following Detailed Description and the figures.

BRIEF DESCRIPTION OF THE DRAWINGS

A number of non-limiting embodiments of the present disclosure will be described by way of example with reference to the accompanying drawings, in which.

DETAILED DESCRIPTION

Figures 1, 2:
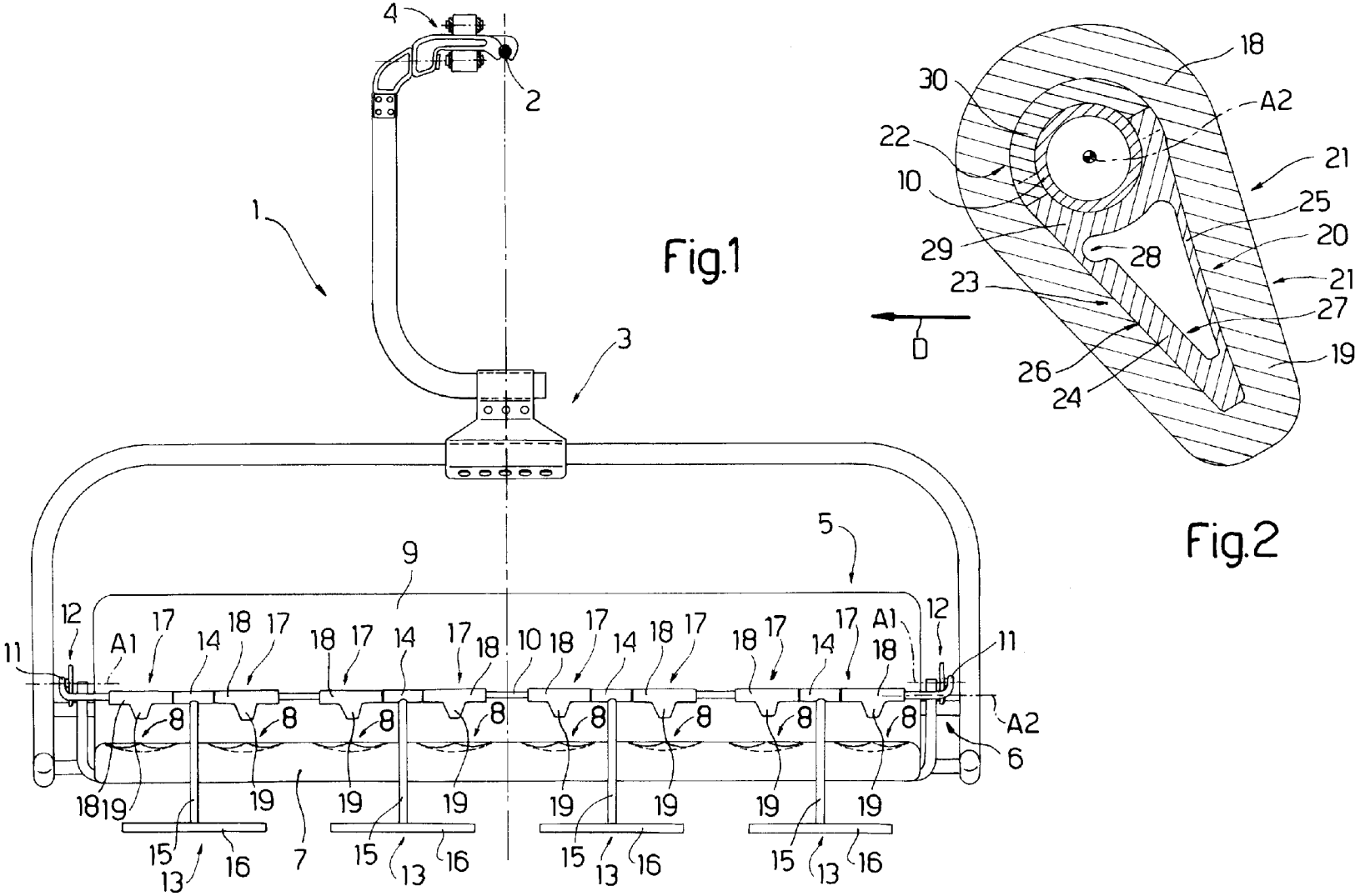
FIG. 1 shows a schematic front view, with parts removed for clarity, of a transportation unit of a cable transportation system, in accordance with the present disclosure.
FIG. 2 shows a larger-scale section, with parts removed for clarity, of a detail of the FIG. 1 transportation unit.

Referring now to the example embodiments of the present disclosure illustrated in FIGS. 1 to 9, number 1 in FIG. 1 indicates as a whole a transportation unit of a cable transportation system, of which FIG. 1 shows a draw cable 2.

Transportation unit 1 is movable in a travelling direction D (as seen in FIG. 2), and comprises a supporting structure 3 attached to draw cable 2; a trolley 4 fixed to supporting structure 3; a chair 5 fitted to supporting structure 3; and a safety frame 6 mounted to rotate about an axis A1 with respect to supporting structure 3.

Chair 5 comprises a bench 7—in the example shown, a bench 7 with eight seats 8—and a backrest 9; and each seat 8 is formed ergonomically in the body of bench 7.

Safety frame 6 comprises a front bar 10 extending along an axis A2 parallel to axis A1; and two side bars 11, each connecting front bar 10 to a respective hinge 12 at backrest 9.

Safety frame 6 comprises four foot-rest devices 13 equally spaced along front bar 10, and each comprising a hub 14, a supporting bar 15, and a foot-rest 16. Hub 14 is fixed to front bar 10 and connected by supporting bar 15 to foot-rest 16, which extends parallel to front bar 10 and on opposite sides of supporting bar 15.

In one alternative embodiment, hub 14 is mounted to rotate about front bar 10, so foot-rest 16 can be adjusted even when safety frame 6 is locked in the closed position.

Safety frame 6 also comprises eight safety barriers 17, each located at a seat 8—more specifically, centrally with respect to seat 8 when safety frame 6 is in the closed position, so that each safety barrier 17 extends partly between the legs of the passenger (not shown in FIG. 1).

Each safety barrier 17 is fixed to front bar 10, and comprises a sleeve 18 fitted about front bar 10; and a projection 19 extending from sleeve 18 towards bench 7. Depending on requirements, projection 19 may be of different lengths, even to the point of the free end of projection 19 contacting bench 7 (as shown by the dash line in FIG. 1). Generally speaking, the free end of the projection faces inwards of chair 5.

Figure 4:
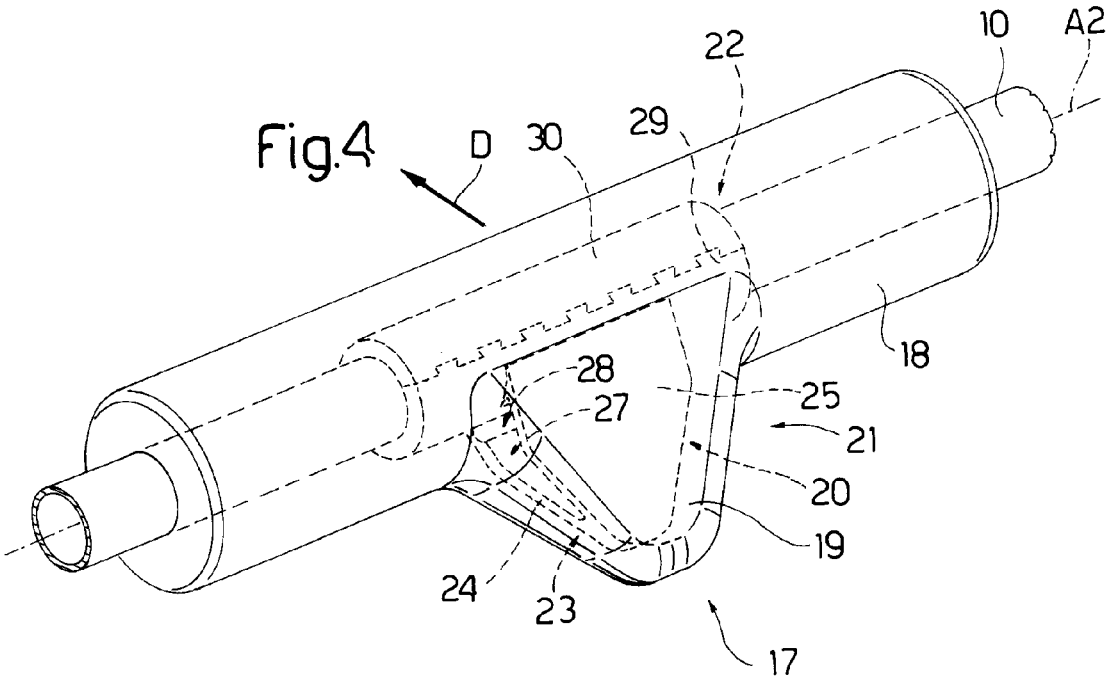
FIG. 4 shows a larger-scale view in perspective, with parts removed for clarity, of a detail of the FIG. 1 transportation unit.

With reference to FIG. 4, safety barrier 17 comprises a support 20, and a cover 21 about support 20.

In one embodiment, support 20 is fixed rigidly to front bar 10, and cover 21 fully encloses support 20 and portions of front bar 10 adjacent to support 20. In other words, support 20 supports cover 21, which is made of more elastic material than support 20. In addition, cover 21 is elastically deformable in any direction, whereas support 20 only flexes elastically under stress oriented in given or designated directions. In one such embodiment, support 20 is made of polymer material, and cover 21 of polymer foam. And the flexibility of support 20 is substantially determined by its geometry.

Figure 3:
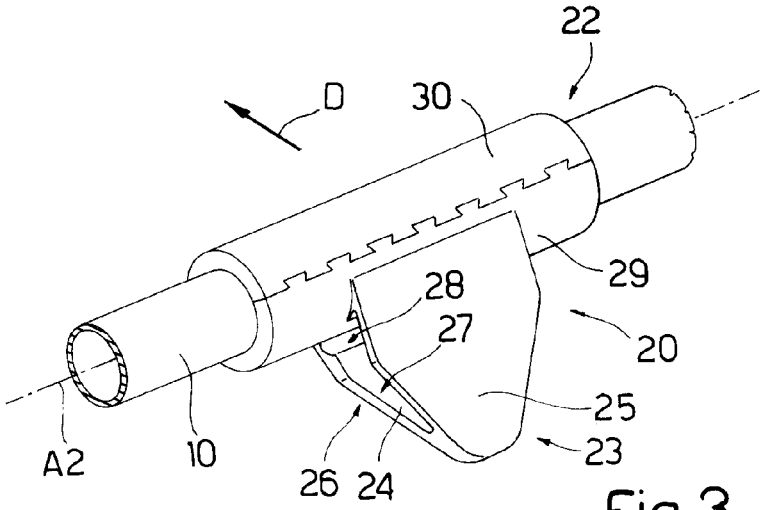
FIG. 3 shows a larger-scale view in perspective, with parts removed for clarity, of a detail of the FIG. 1 transportation unit.

With reference to FIG. 3, in one embodiment, support 20 comprises an anchoring portion 22 fixed to and extending parallel to front bar 10; and a projecting portion 23, which projects from anchoring portion 22 towards bench 7 when frame 6 is in the closed position (as seen in FIG. 1), is elastically flexible, and comprises a wall 24 integral with anchoring portion 22, and a wall 25 connecting anchoring portion 22 to wall 24, and which is thinner and therefore more flexible than wall 24. Wall 24 is weakened to promote elastic deformation at a given or designated point of support 20. More specifically, wall 24 has a face 26; a face 27 opposite face 26; and a groove 28 formed along face 27, close to anchoring portion 22 (as shown more clearly in FIG. 2). Groove 28, in fact, defines the weakened portion of wall 24, and is parallel to front bar 10.

With reference to FIG. 2, in one embodiment, anchoring portion 22, wall 24, and wall 25 define a gap, and groove 28 promotes flexing of wall 24 under stress oriented in given or designated directions, which, in the example shown, are any directions towards face 26 of wall 24 and which have at least one component perpendicular to face 26. Generally speaking, wall 24 curves about the weakened portion under stress oriented at least partly perpendicular to and towards face 26. Under such stress, wall 24 curves or flexes about the weakened portion, and also causes flexing of wall 25, which, being thinner, opposes no resistance.

Under stress in the opposite direction to the one described, wall 25 acts as a tie, preventing flexing of wall 24.

With reference to FIG. 3, in one embodiment walls 24 and 25 are crosswise to travelling direction D, are trapezoidal, are integral with anchoring portion 22, and are integral with each other at their respective free ends.

Anchoring portion 22 comprises two half-shells 29, 30 parallel to front bar 10 and fitted together, to grip front bar 10, by screws or other fasteners (not shown in the drawings). In the example shown, walls 24 and 25 are integral with each other and formed integrally with half-shell 29.

In other words, the geometry of support 20 permits flexing of projecting portion 23. More specifically, the location of groove 28 determines the flexing path and direction of projecting portion 23; and the amount by which projecting portion 23 flexes is substantially determined by the depth and width of groove 28.

Elastic deformation under stress of support 20 of safety barrier 17 can thus be controlled, to achieve transportation units 1 which ensure effective fall prevention combined with a high degree of passenger comfort.

Though specific reference is made herein to a chair 5 with eight seats 8, it is understood that the present disclosure also applies to transportation units comprising any number or quantity of seats.

Figure 6:
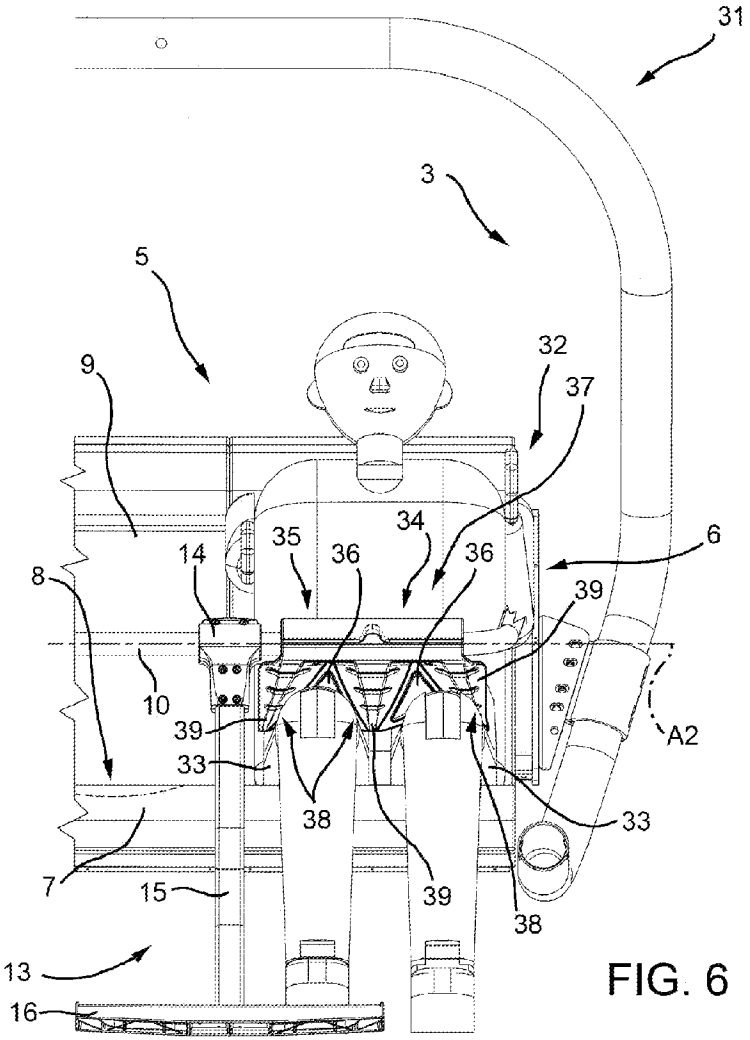
FIG. 6 shows a front view, with parts removed for clarity, of the FIG. 5 transportation unit.
Figure 5:
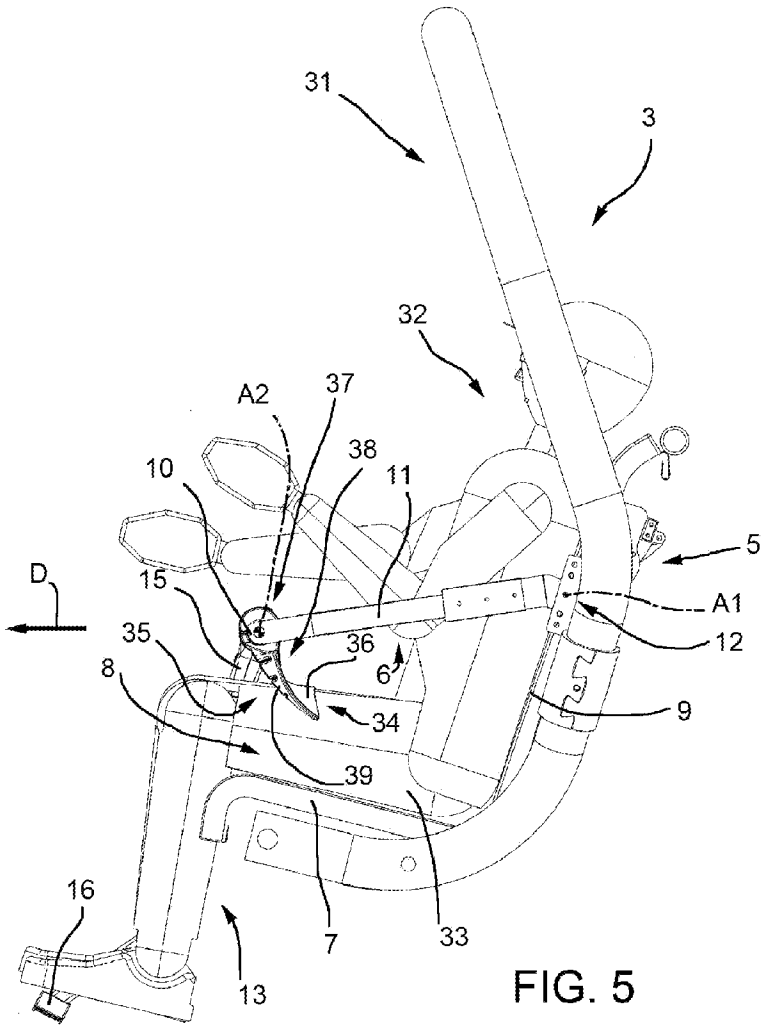
FIG. 5 shows a side view, with parts removed for clarity, of a second embodiment of a transportation unit in accordance with the present disclosure.

Number 31 in FIGS. 5 and 6 indicates as a whole a transportation unit with structural parts similar to those of transportation unit 1, and which, for the sake of simplicity, are therefore indicated using the same reference numbers as in FIG. 1.

FIGS. 5 and 6 also show a passenger 32 in the form of a dummy having two thighs 33 and seated in a seat 8 of transportation unit 31.

For each seat 8, transportation unit 31 comprises a safety barrier 34 which, in use, extends partly about the thighs 33 of passenger (e.g., dummy) 32.

Figure 7:
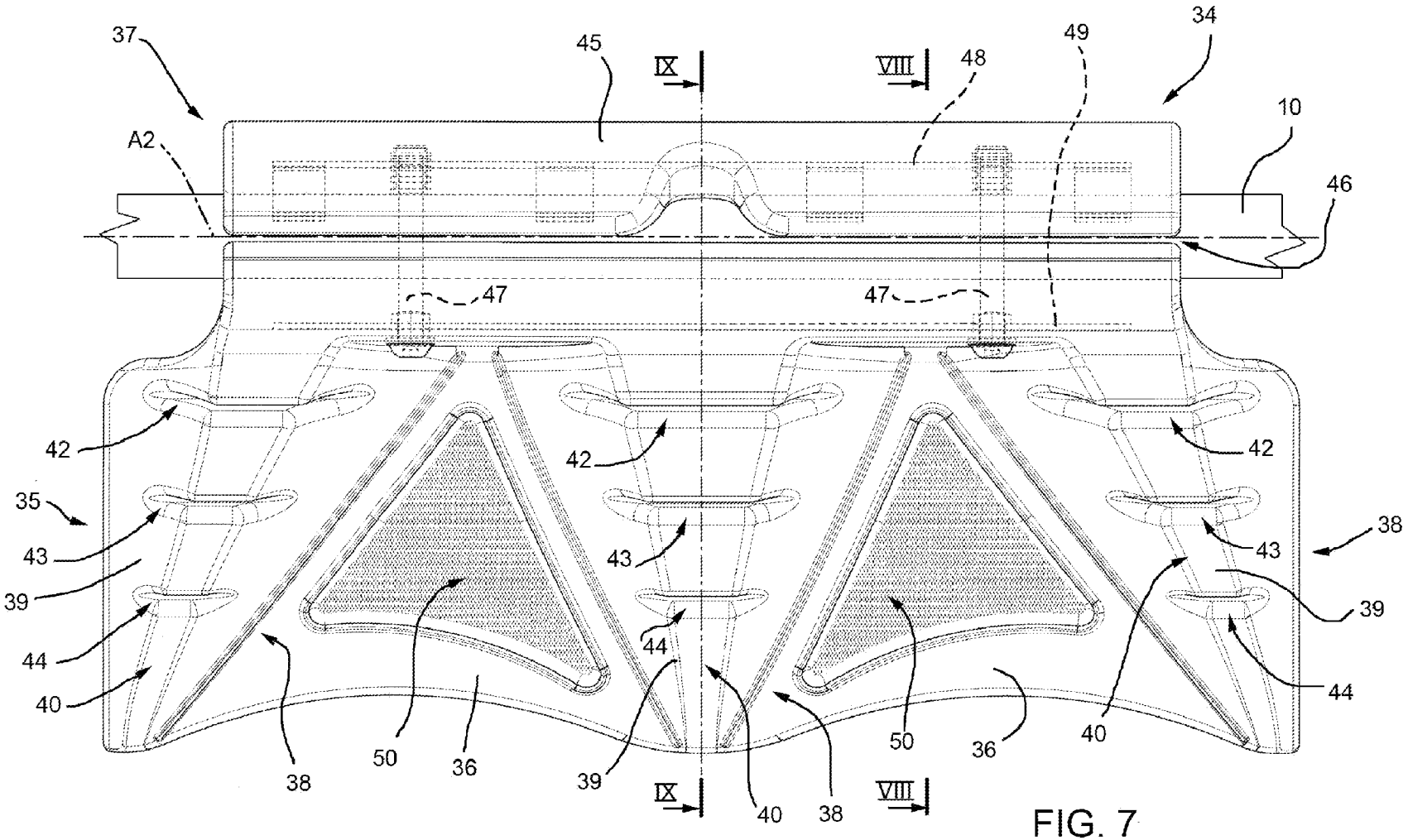
FIG. 7 shows a larger-scale front view, with parts removed for clarity, of a detail of the FIG. 5 transportation unit.

With reference to FIG. 7, in one embodiment, safety barrier 34 comprises a support 35; and two flexible sheets 36 integral with each other and formed integral with support 35.

Support 35 is fixed rigidly to front bar 10, is flexible under stress oriented in given or designated directions, and is substantially rigid under stress in other directions.

In one embodiment, support 35 and flexible sheets 36 are formed integral with one another from polymer material. In one embodiment, support 35 and flexible sheets 36 are formed integral with one another, with a shell of polymer material filled with foam material. The flexibility of support 35 is substantially determined by its geometry.

In the example shown, support 35 comprises an anchoring portion 37 fixed to and extending parallel to front bar 10; and three projecting portions 38, each of which projects from anchoring portion 37 towards bench 7 when frame 6 is in the closed position (as seen in FIG. 6), is flexible, and comprises a wall 39 integral with anchoring portion 37. Projecting portions 38 are arranged along axis A2, and each flexible sheet 36 is located between two projecting portions 38. As shown in FIG. 5, projecting portions 38 face inwards of chair 5.

In one embodiment, each wall 39 has weakened portions to promote elastic deformation in given or designated areas. More specifically, each wall 39 has a face 40; a face 41 opposite face 40 (as seen in FIGS. 8 and 9); and three grooves 42, 43, 44 formed, parallel to front bar 10, along face 40, and defining weakened portions of wall 39.

Faces 40 of walls 39 are substantially triangular, with a vertex of the triangle facing bench 7 (as seen in FIG. 6), and one side adjacent to anchoring portion 37.

Figure 9:
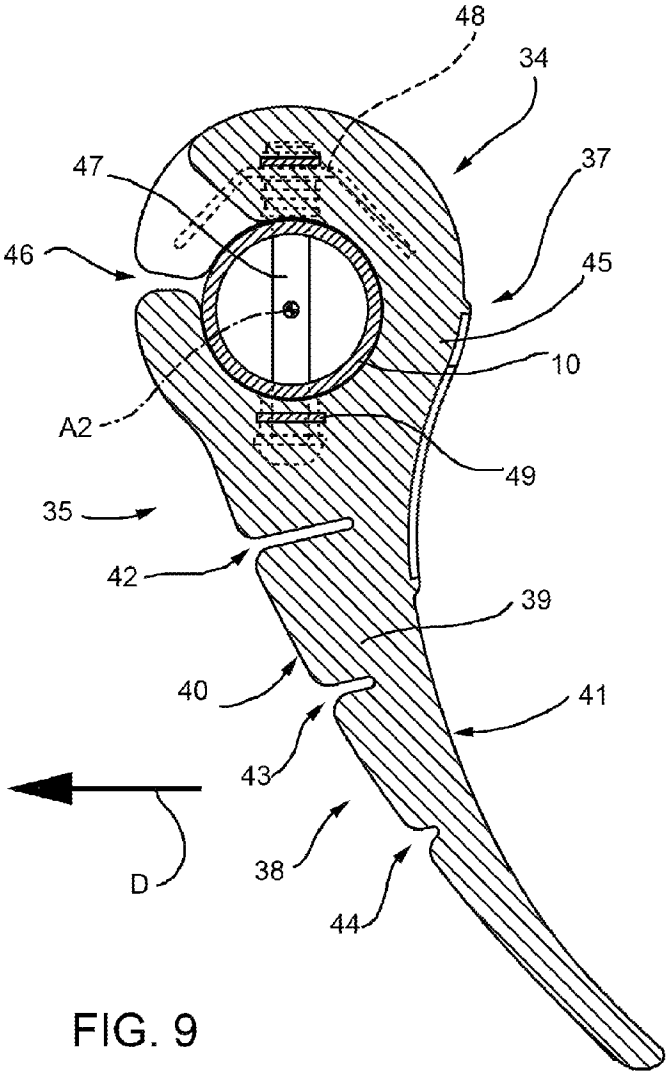
FIGS. 8 and 9 show sections of the FIG. 7 detail, with parts removed for clarity, along lines VIII-VIII and IX-IX respectively.
Figure 8:
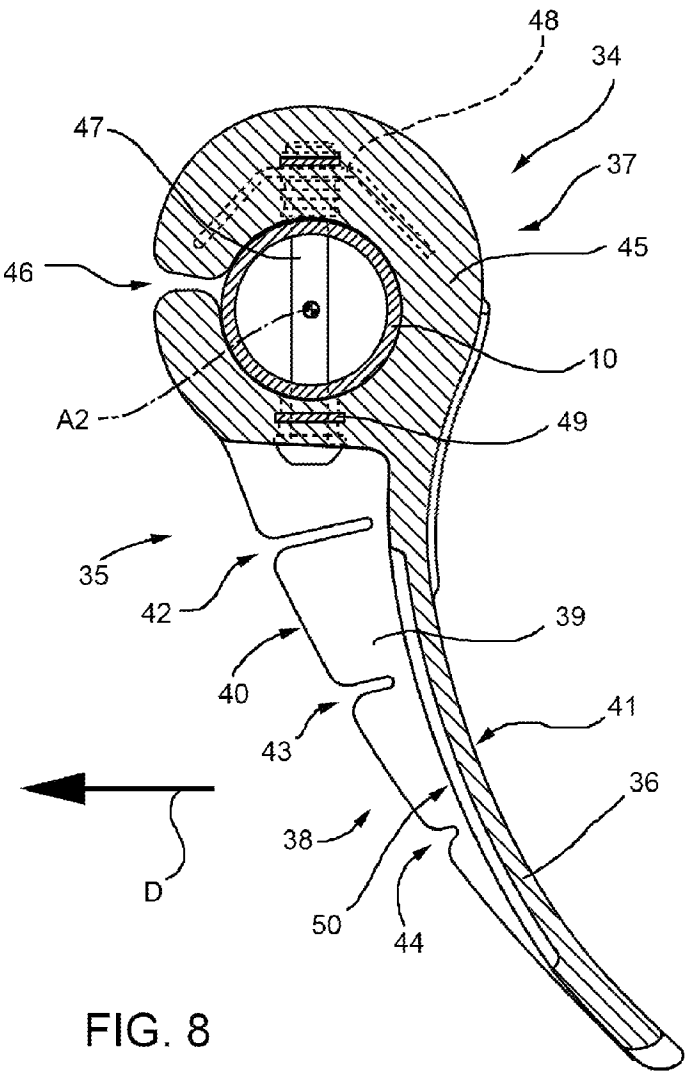

With reference to FIGS. 8 and 9, in one embodiment, each wall 39 is crosswise to travelling direction D, and gets thinner away from anchoring portion 37; grooves 42, 43, 44 get shallower away from anchoring portion 37; and walls 39 are curved—in the example shown, face 40 is convex, and face 41 concave.

In one embodiment, anchoring portion 37 comprises a tubular member 45, which has a longitudinal slit 46 by which to insert front bar 10, and is fixed to front bar 10 by bolts 47. Anchoring portion 37 also comprises a finned plate 48 and a plate 49, which are incorporated in tubular member 45 to increase the rigidity of tubular member 45, and are engaged by bolts 47, which also engage front bar 10.

With reference to FIG. 7, in one embodiment, each flexible sheet 36 is located between two walls 39, is characterized by being substantially thinner than the root of walls 39, as shown more clearly in FIGS. 8 and 9, and has a knurled face 50 to increase friction with the thighs 33 of passenger (e.g., dummy) 32 (as seen in FIGS. 5, 6).

With reference to FIG. 6, in actual use of one embodiment, flexible sheets 36 wrap about the thighs 33 of passenger (e.g., dummy) 32, and walls 39 are positioned and deform partly on respective sides of thighs 33. Deformation is elastic and concentrated in the areas of walls 39 in which grooves 42, 43, 44 are formed (as seen in FIG. 7). With reference to FIGS. 8 and 9, elastic deformation is actually determined by stress perpendicular to or having components perpendicular to face 40, and causes flaring of grooves 42, 43, 44. Conversely, stress directed towards face 41 immediately closes grooves 42, 43, 44, so that wall 39 acts as a substantially rigid member.

In one embodiment, safety barrier 34 is flat, to form a sort of shield in front of the passenger. This shield ensures a high degree of safety by virtue of the large area covered, performs rigidly to prevent the passenger from falling (sliding off between the bench and front bar), but flexes in response to other than falling passenger movements, thus combining both passenger safety and comfort.

Despite covering a large area, safety barrier 34 is relatively compact, and is easy to produce and install, even on transportation units not originally configured for this type of fixture.

The present disclosure also covers embodiments not described herein and equivalent embodiments, which nevertheless fall within the protective scope of the accompanying Claims. That is, it should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A cable transportation system transportation unit movable in a travelling direction, said cable transportation system transportation unit comprising:

a chair with a bench; and a safety frame configured to move between an open position and a closed position, said safety frame including:

a front bar, and at least one safety barrier which is fixed to the front bar, and which extends predominantly between the front bar and the bench when the safety frame is in the closed position, said at least one safety barrier including:

an anchoring portion fixed to the front bar, and at least one projecting portion which projects from the anchoring portion and has a front side and a back side, wherein only the front side is provided with a one-directional weakening configuration to provide a substantial bending capability for the projecting portion to bend in a first direction toward the back side under stress against the front side, but also to provide a substantial rigidity to the projection portion for resisting a substantial bending in an opposite second direction toward the front side under stress against the back side.

2. The cable transportation system transportation unit of claim 1, wherein the at least one projecting portion includes a first wall crosswise to said travelling direction and having at least one weakened portion to promote flexibility of said at least one projecting portion.

3. The cable transportation system transportation unit of claim 2, wherein the at least one weakened portion is defined by a groove.

4. The cable transportation system transportation unit of claim 3, wherein the groove is substantially parallel to the front bar.

5. The cable transportation system transportation unit of claim 3, wherein the first wall includes at least one face and said groove is formed in the first wall along said at least one face.

6. The cable transportation system transportation unit of claim 1, wherein the at least one projecting portion is elastically flexible about an axis substantially parallel to the front bar.

7. The cable transportation system transportation unit of claim 1, wherein the at least one projecting portion has a free end facing inwards of said chair when said safety frame is in the closed position.

8. The cable transportation system transportation unit of claim 1, wherein the chair has a quantity of seats and a quantity of safety barriers equal to the quantity of seats and each safety barrier is located centrally with respect to a respective one of the seats when the safety frame is in the closed position.

9. The cable transportation system transportation unit of claim 1, wherein a free end of the at least one safety barrier is positioned contacting the bench when said safety frame is in the closed position.

10. The cable transportation system transportation unit of claim 1, wherein said anchoring portion of said at least one safety barrier includes a polymer material.

11. The cable transportation system transportation unit of claim 2, wherein the at least one projecting portion includes a second wall facing the first wall and connecting the anchoring portion to the first wall.

12. The cable transportation system transportation unit of claim 11, wherein the anchoring portion, the first wall, and the second wall define a gap.

13. The cable transportation system transportation unit of claim 11, wherein the second wall is thinner than the first wall.

14. The cable transportation system transportation unit of claim 11, wherein the first wall and the second wall are integral with the anchoring portion.

15. The cable transportation system transportation unit of claim 11, wherein the safety barrier includes a cover enclosing at least said anchoring portion.

16. The cable transportation system transportation unit of claim 15, wherein the cover encloses at least part of the front bar adjacent to the anchoring portion.

17. The cable transportation system transportation unit of claim 15, wherein said cover includes a polymer foam.

18. The cable transportation system transportation unit of claim 2, wherein the at least one safety barrier has three projecting portions which are configured to be positioned alongside thighs of a passenger.

19. The cable transportation system transportation unit of claim 1, wherein the at least one projecting portion is elastically flexible under stress oriented in a plurality of first directions.

20. The cable transportation system transportation unit of claim 19, wherein the at least one projecting portion is substantially rigid under stress oriented in a plurality of second directions, each of the plurality of first directions being different from each of the plurality of second directions.

21. A cable transportation system transportation unit movable in a travelling direction, said cable transportation system transportation unit comprising:

a chair with a bench; and a safety frame configured to move between an open position and a closed position, said safety frame including:

a front bar, and at least one safety barrier which is fixed to the front bar, and which extends predominantly between the front bar and the bench when the safety frame is in the closed position, said at least one safety barrier including:

an anchoring portion fixed to the front bar, and three projecting portions each configured to be positioned alongside thighs of a passenger and which each project from the anchoring portion, each projecting portion including a wall having three weakened portions defined by a plurality of grooves, each of the walls of the three projecting portions being crosswise to said travelling direction, and each of the three projecting portions being elastically flexible under stress oriented in a first direction, and substantially rigid under stress oriented in a second, different direction.

22. A cable transportation system transportation unit movable in a travelling direction, said cable transportation system transportation unit comprising:

a chair with a bench; and a safety frame configured to move between an open position and a closed position, said safety frame including:

a front bar, and at least one safety barrier which is fixed to the front bar, and which extends predominantly between the front bar and the bench when the safety frame is in the closed position, said at least one safety barrier including:

an anchoring portion fixed to the front bar, three projecting portions each configured to be positioned alongside thighs of a passenger and which each project from the anchoring portion, each projecting portion including a wall crosswise to said travelling direction and having at least one weakened portion to promote flexibility of said projecting portion, and each of the three projecting portions being elastically flexible under stress oriented in a first direction, and substantially rigid under stress oriented in a second, different direction, and two flexible sheets which are configured to be positioned contacting thighs of the passenger, each flexible sheet extending between two of the projecting portions.

* * * * *